US010266375B2

(12) United States Patent
Tanaka et al.

(10) Patent No.: US 10,266,375 B2
(45) Date of Patent: Apr. 23, 2019

(54) TRACTION MACHINE BASE OF ELEVATOR AND ELEVATOR DEVICE

(75) Inventors: Ryoji Tanaka, Tokyo (JP); Hideki Nakamura, Tokyo (JP); Shigeki Mizuno, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 837 days.

(21) Appl. No.: 14/383,300

(22) PCT Filed: May 30, 2012

(86) PCT No.: PCT/JP2012/063966
§ 371 (c)(1),
(2), (4) Date: Sep. 5, 2014

(87) PCT Pub. No.: WO2013/179423
PCT Pub. Date: Dec. 5, 2013

(65) Prior Publication Data
US 2015/0027815 A1 Jan. 29, 2015

(51) Int. Cl.
*B66B 9/00* (2006.01)
*B66B 11/00* (2006.01)

(52) U.S. Cl.
CPC ..... *B66B 11/004* (2013.01); *B66B 9/00* (2013.01)

(58) Field of Classification Search
CPC ..... B66B 11/004; F16M 1/08
(Continued)

(56) References Cited

U.S. PATENT DOCUMENTS 1,850,118 A * 3/1932 Meyers ..... E04B 1/24 52/223.6
4,220,308 A * 9/1980 Strien ..... B60N 2/682 248/424

(Continued)

FOREIGN PATENT DOCUMENTS

CN 201712560 U 1/2011
JP 58-137681 9/1983

(Continued)

OTHER PUBLICATIONS

Combined Chinese Office Action and Search Report dated Nov. 3, 2015 in Patent Application No. 201280073586.3 (with partial English translation and English translation of categories of cited documents).

(Continued)

*Primary Examiner* — Minh Truong
(74) *Attorney, Agent, or Firm* — Oblon, McClelland, Maier & Neustadt, L.L.P.

(57) ABSTRACT

A traction machine base includes a top member, a bottom member, a bottom member, first bolts, and second bolts. The top member is intended for supporting a traction machine. A plurality of attachment holes for fixing the top member are formed in the bottom member. A plurality of attachment holes for fixing the top member are formed in the bottom member. The first bolts pass through the attachment holes and fix the top member to the bottom member. The second bolts pass through the attachment holes and fix the top member to the bottom member. The top member is fixed to the bottom member using a smaller number of the first bolts than the number of the attachment holes. The top member is fixed to the bottom member using a smaller number of the second bolts than the number of the attachment holes.

7 Claims, 14 Drawing Sheets

(58) Field of Classification Search
USPC ..... 248/670, 674, 676, 678
See application file for complete search history.

(56) References Cited

U.S. PATENT DOCUMENTS

| | | | | |
|---|---|---|---|---|
| 4,807,723 | A * | 2/1989 | Salmon | B66B 11/08 187/254 |
| 5,076,398 | A * | 12/1991 | Heikkinen | B66B 11/08 187/266 |
| 5,396,782 | A * | 3/1995 | Ley | F16F 15/04 248/636 |
| 5,957,242 | A * | 9/1999 | Suter | B66B 11/004 187/251 |
| 7,083,026 | B2 * | 8/2006 | Cholinski | B66B 11/00 187/251 |
| 7,562,745 | B2 * | 7/2009 | Ishii | B66B 11/0015 187/254 |
| 8,025,134 | B2 * | 9/2011 | Foge | F16B 39/225 188/251 A |
| 8,302,740 | B2 * | 11/2012 | Swaybill | B66B 7/08 187/254 |
| 2011/0278098 | A1 * | 11/2011 | Ketonen | B66B 11/0206 187/266 |
| 2012/0305335 | A1 * | 12/2012 | Klumpers | B66B 11/00 187/266 |
| 2013/0181108 | A1 * | 7/2013 | Koepf | B23Q 37/00 248/676 |

FOREIGN PATENT DOCUMENTS

| | | |
|---|---|---|
| JP | 60-236989 | 11/1985 |
| JP | 3-26684 | 2/1991 |
| JP | 6-135666 | 5/1994 |
| JP | 7-81861 | 3/1995 |
| JP | 2005-254846 | 9/2005 |
| JP | 2007-70082 | 3/2007 |
| JP | 2007-182270 | 7/2007 |
| JP | 2012-46287 | 3/2012 |
| WO | WO 2011/051559 A1 | 5/2011 |

OTHER PUBLICATIONS

Office Action dated Apr. 20, 2016 in Korean Patent Application No. 10-2014-7031117 with English translation.

International Preliminary Report on Patentability and Written Opinion dated Dec. 11, 2014, in International Application No. PCT/JP2012/063966 (English translation only).

International Search Report dated Jul. 31, 2012 in PCT/JP12/063966 filed May 30, 2012.

* cited by examiner

TRACTION MACHINE BASE OF ELEVATOR AND ELEVATOR DEVICE

TECHNICAL FIELD

The present invention relates to a traction machine base for supporting a traction machine of an elevator and an elevator device which includes the traction machine base.

BACKGROUND ART

Patent Literature 1 to Patent Literature 3 each describe a device for supporting a traction machine of an elevator.

The device for supporting the fraction machine is required to have various functions. For example, the function of stably holding the traction machine is required of the support device. In the devices described in Patent Literature 1 to Patent Literature 3, a plurality of steel members are fixed by welding and bolts, whereby the above-described function is realized.

CITATION LIST

Patent Literature

Patent Literature 1: Japanese Utility Model Laid-Open No. 58-137681

Patent Literature 2: Japanese Patent Laid-Open No. 7-81861

Patent Literature 3: Japanese Patent Laid-Open No. 2007-70082

SUMMARY OF INVENTION

Technical Problem

The positional relationship (arrangement) of a car and a counterweight in a shaft is decided by the layout design of an elevator. In deciding the positional relationship, various requests are made by those who concerned with architectural design. It is necessary that the traction machine and deflector sheave of an elevator be appropriately arranged in such a manner as to adapt to the suspension position of a car and the suspension position of a counterweight.

Because a support device has hitherto been fabricated in such a manner as to adapt to the arrangement of the traction machine and deflector sheave, it was necessary to fabricate various kinds of support devices. In fabricating a support device, a production method by which semi-processed products are produced in advance is often adopted in order to shorten the fabrication period. In this case, the number and kinds of members stored in a warehouse increase. For this reason, this production method had the problem that a wide storage space was necessary, resulting in an increase in management cost related to storage.

The present invention was made in order to solve the above-described problem and an object of the present invention is to provide a traction machine base of an elevator capable of substantially reducing the kinds of members and parts which are fabricated and stored.

Another object of the present invention is to provide an elevator device which includes such a traction machine base.

Solution to Problem

A traction machine base of an elevator of the present invention is a base which comprises a first member for supporting an elevator traction machine, a second member in which a plurality of first attachment holes for fixing the first member are formed and the plurality of first attachment holes are arranged in a line in a prescribed direction, a third member in which a plurality of second attachment holes for fixing the first member are formed and the plurality of second attachment holes are arranged in a line in the same direction as the line of the first attachment holes, first bolts which pass through the first attachment holes and fix the first member to the second member, and second bolts which pass through the second attachment holes and fix the first member to the third member. The first member is fixed to the second member using a smaller number of the first bolts than the number of the first attachment holes, and is fixed to the third member using a smaller number of the second bolts than the number of the second attachment holes.

An elevator device of the present invention is a device which comprises the traction machine base, a traction machine supported on the traction machine base, a main rope wound on a driving sheave of the traction machine, and a car and a counterweight which are suspended by the main rope in a shaft.

Advantageous Effect of Invention

According to the present invention, it is possible to substantially reduce kinds of members and parts which are fabricated and stored.

DESCRIPTION OF EMBODIMENT

Figure 1:
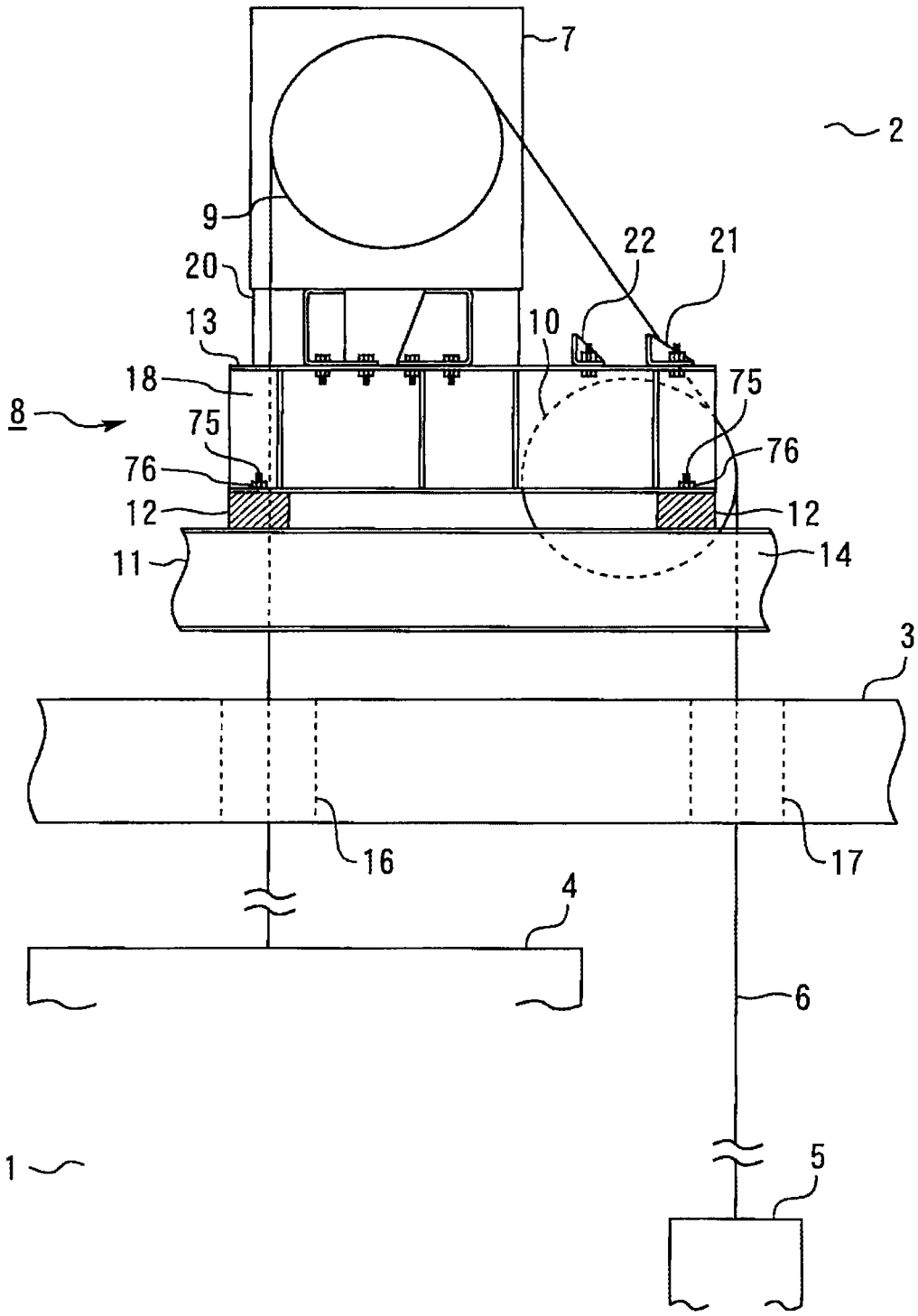
FIG. 1 is a front view showing the main part of an elevator device according to Embodiment 1 of the present invention.

The present invention will be described in detail with reference to the accompanying drawings. In each of the drawings, identical reference numerals refer to identical or corresponding parts. Redundant descriptions are appropriately simplified or omitted.

Embodiment 1

FIG. 1 is a front view showing the main part of an elevator device according to Embodiment 1 of the present invention.

In FIG. 1, reference numeral 1 denotes a shaft of an elevator, and reference numeral 2 denotes a machine room of the elevator. The shaft 1 is formed so as to pass through each floor of a building. The machine room 2 is formed above the shaft 1. Reference numeral 3 denotes a floor portion. The top surface of the floor portion 3 forms the floor surface of the machine room 2. The bottom surface of the floor portion 3 forms, for example, the ceiling surface of the shaft 1.

Reference numeral 4 denotes a car of the elevator, and reference numeral 5 denotes a counterweight of the elevator. The car 4 ascends and descends in the shaft 1. The car 4 and the counterweight 5 are suspended by a main rope 6 in the shaft 1. For example, one end of the main rope 6 is connected to a top portion of the car 4. The other end of the main rope 6 is connected to a top portion of the counterweight 5.

FIG. 1 shows the 1:1 roping method. For other roping methods (for example, the 2:1 roping method), illustrations and descriptions thereof are omitted.

Reference numeral 7 denotes a traction machine of the elevator. The traction machine 7 is a device for driving the car 4 (causing the car 4 to ascend and descend). The traction machine 7 is provided in the machine room 2 via a support device 8. The traction machine 7 includes a driving sheave 9. The main rope 6 is such that a portion thereof is wound on the driving sheave 9. The main rope 6 extends downward from the portion thereof which is wound on the driving sheave 9, and an end of a portion which extends downward from the driving sheave 9 is connected to the car 4. Another portion of the main rope 6 is wound on a deflector sheave 10. The main rope 6 extends downward from the portion thereof which is wound on the deflector sheave 10, and an end of a portion which extends downward from the deflector sheave 10 is connected to the counterweight 5. When the driving sheave 9 rotates, the main rope 6 moves in the longitudinal direction thereof. The car 4 ascends and descends in the shaft 1 in the direction which corresponds to the moving direction of the main rope 6. The counterweight 5 ascends and descends in the shaft 1 in the direction reverse to the car 4.

The support device 8 is a device for supporting the traction machine 7. The support device 8 is such that the main part thereof is composed of, for example, a machine foundation 11, a vibration-proofing device 12, and a traction machine base 13.

The support device 8 has various functions. For example, the support device 8 has the function of distributing the force received from the traction machine 7 and the deflector sheave 10 and transmitting the force to the building side via the floor portion 3 and building beams (not shown). Also the support device 8 has the function of stably holding the traction machine 7 with a prescribed horizontality. The support device 8 has the function of reducing vibrations which propagate from the traction machine 7 to the building via the floor portion 3 and building beams (not shown). The support device 8 has the function of arranging the driving sheave 9 at a prescribed height.

Furthermore, the support device 8 is configured so as to be capable of appropriately setting the position of the traction machine 7 in such a manner as to adapt to the suspension position of the car 4 and the suspension position of the counterweight 5.

In the following, referring to also FIG. 2 to FIG. 22, the configuration and functions of the support device 8 will be described specifically.

In the following, as an example, a description will be given of the configuration obtained when an existing elevator is renewed. The configuration obtained when an elevator is newly installed in a building will be easily understood on the basis of the following description and, therefore, the description of this configuration is omitted.

Figure 2:
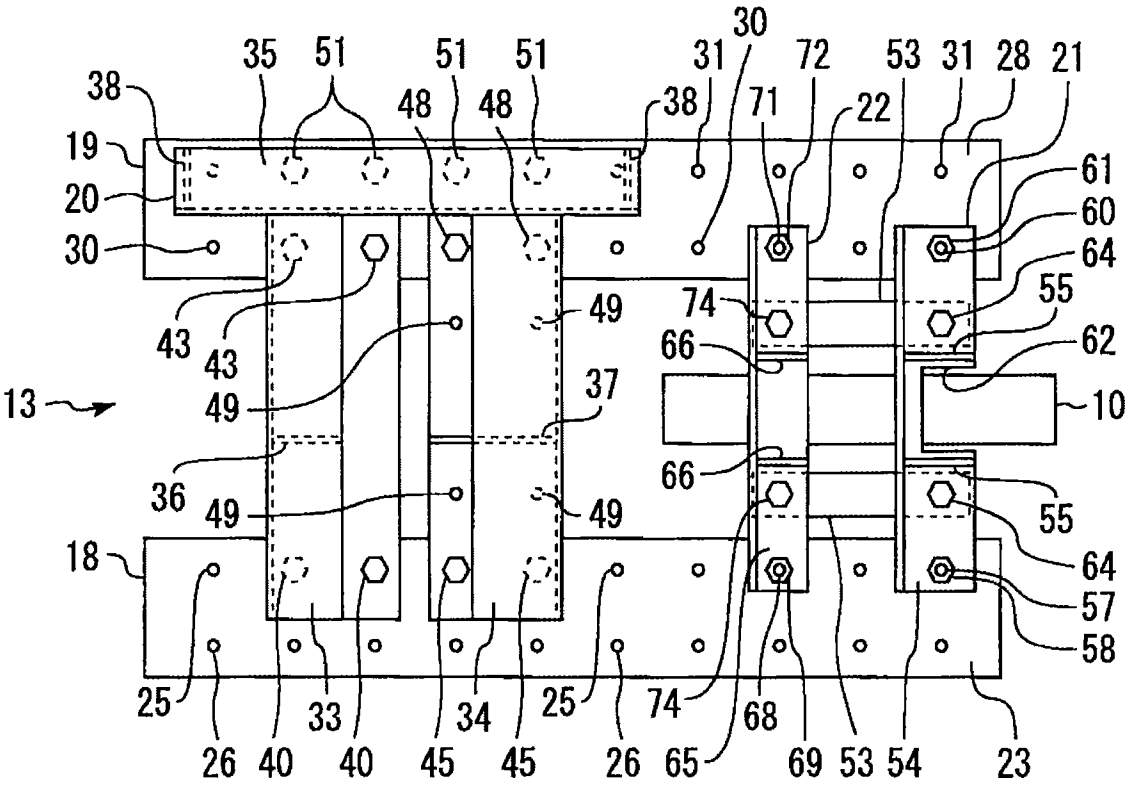
FIG. 2 is a plan view showing the main part of a support device of an elevator traction machine according to Embodiment 1 of the present invention.
Figure 3:
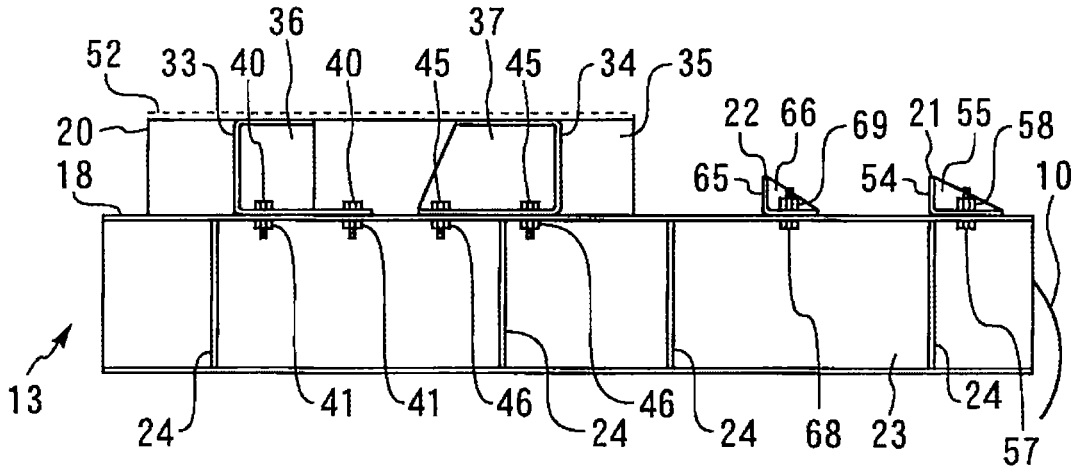
FIG. 3 is a front view showing the main part of the support device of the elevator traction machine according to Embodiment 1 of the present invention.
Figure 4:
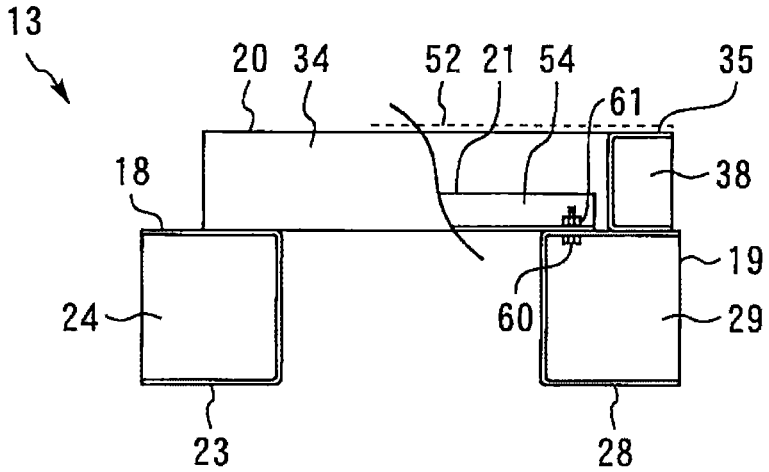
FIG. 4 is a side view showing the main part of the support device of the elevator traction machine according to Embodiment 1 of the present invention.

FIG. 2 is a plan view showing the main part of the support device of an elevator traction machine according to Embodiment 1 of the present invention. FIG. 3 is a front view showing the main part of the support device of the elevator traction machine according to Embodiment 1 of the present invention. FIG. 4 is a side view showing the main part of the support device of the elevator traction machine according to Embodiment 1 of the present invention.

The machine foundation 11 is fixed to the floor portion 3 of the machine room 2. The machine foundation 11 is fixed to the floor portion 3 using, for example, welding or bolts (for example, anchor bolts). In the case where the machine foundation 11 is fixed to the floor portion 3 using anchor bolts, in order to make the floor surface of the machine room 2 flat, lightweight concrete may be poured onto the floor portion 3 and hardened. In this case, the bottom portion of the machine foundation 11 may be covered with lightweight concrete.

FIG. 1 shows, as an example, the case where the machine foundation 11 is fixed to the floor portion 3 using a floatation bed (not shown). By using the floatation bed, the machine foundation 11 can be fixed to the floor portion 3, with the machine foundation 11 caused to apart from the top surface of the floor portion 3.

Figure 5:
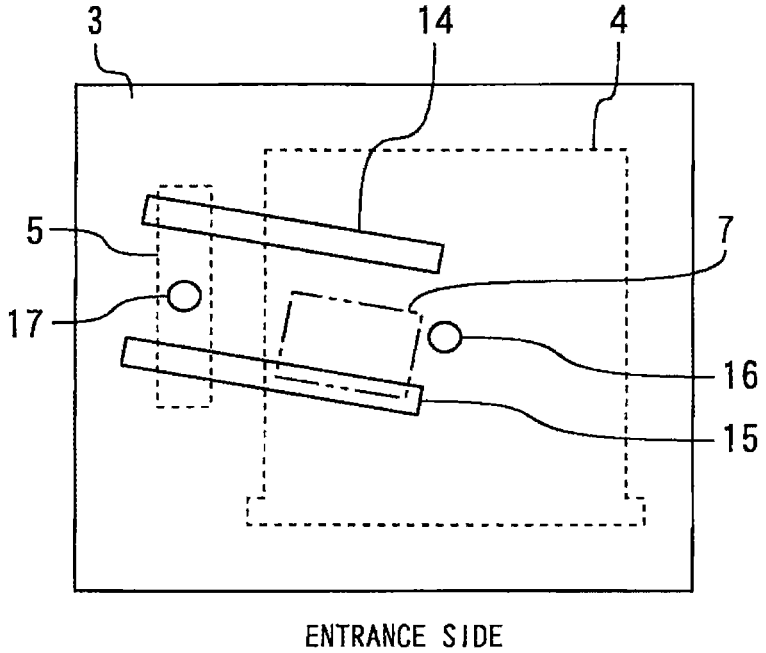
FIG. 5 is a plan view showing the main part of the elevator device according to Embodiment 1 of the present invention.

The machine foundation 11 includes, for example, two steel members 14 and 15 whose section has the shape of H (or the shape of I or the shape of C). FIG. 5 is a plan view showing the main part of the elevator device according to Embodiment 1 of the present invention. FIG. 5 shows an example of arrangement of the steel members 14 and 15 with respect to the car 4 and the counterweight 5. In the elevator shown in FIG. 5, the counterweight 5 passes between the car 4 and a shaft wall on one side.

In the floor portion 3 of the machine room 2, a rope hole 16 is formed in an area just above the suspension position of the car 4. The portion of the main rope 6 ranging from the car 4 to the driving sheave 9 passes through the rope hole 16. In the floor portion 3 of the machine room 2, a rope hole 17 is formed in an area just above the suspension position of the counterweight 5. The portion of the main rope 6 ranging from the counterweight 5 to the deflector sheave 10 passes through the rope hole 17. The steel members 14 and 15 are arranged on both sides of the rope holes 16 and 17 horizontally and parallel. That is, the rope holes 16 and 17 are arranged between the steel members 14 and 15 (including between extended lines).

In the case of the renewal of an elevator, an existing car 4 and an existing counterweight 5 are often used as they are. If the suspension position of the car 4 and the suspension position of the counterweight 5 are not changed, also for the rope holes 16 and 17 and the machine foundation 11, existing ones can be used as they are. On the other hand, in the case of the renewal of an elevator, the traction machine 7 is often replaced with a new one. In this case, it is necessary to replace the traction machine base 13 and the vibration-proofing device 12 with new ones.

The traction machine base 13 is a device for supporting the traction machine 7. The traction machine base 13 is fixed to the machine foundation 11 via the vibration-proofing device 12. The traction machine 7 is fixed to a prescribed fixing surface formed on the traction machine base 13. The deflector sheave 10 is provided on the traction machine base 13 to be freely rotatable so that the rotational axis thereof becomes parallel to the rotational axis of the driving sheave 9.

The traction machine base 13 includes, for example, bottom members 18 and 19, a top member 20, and attachment members 21 and 22.

The bottom member 18 (second member) is composed of, for example, a long steel member 23 and a plurality of reinforcement members 24.

The steel member 23 has, for example, a channel shape in section and opens sideways. The steel member 23 is such that a plurality of attachment holes 25 (first attachment holes) are formed in the top surface thereof. The attachment holes 25 are holes for fixing the top member 20 to the steel member 23 (the bottom member 18). In FIG. 2, reference numeral 25 is given to only part of the attachment holes, but the attachment holes 25 are arranged in a line at equal intervals along the longitudinal part of the steel members 23 (in the longitudinal direction). The steel member 23 is such that a plurality of attachment holes 26 are formed in the top surface thereof. Also the attachment holes 26 are holes for fixing the top member 20 to the steel member 23. The attachment holes 26 are arranged in a line at equal intervals along the longitudinal part of the steel member 23. The line of the attachment holes 26 is arranged parallel to the line of the attachment holes 25.

Figure 6:
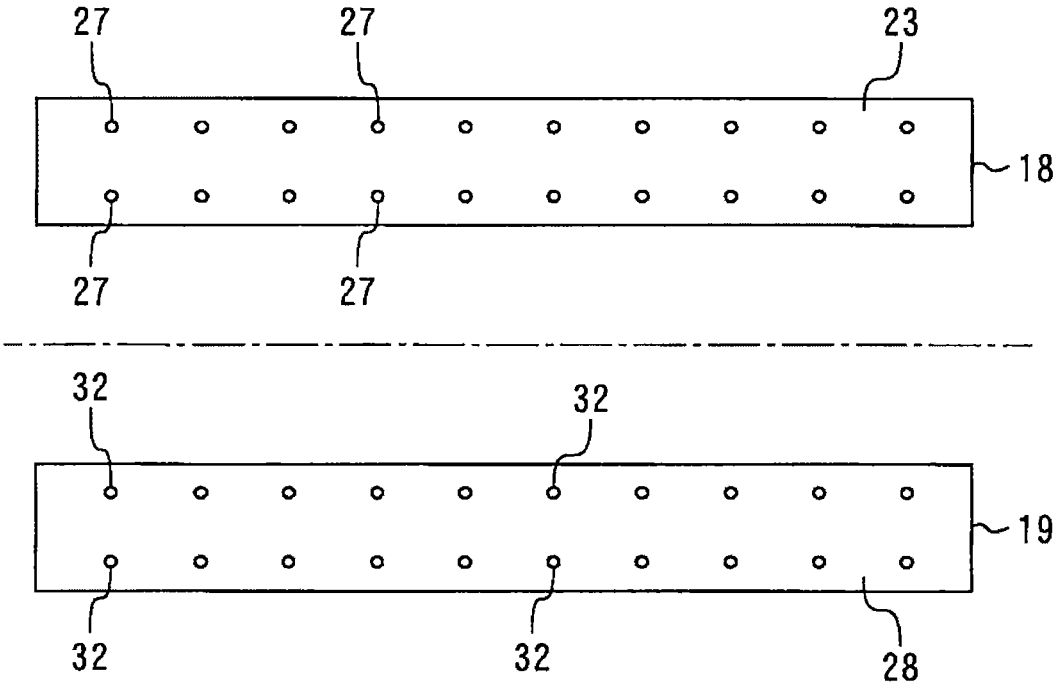
FIG. 6 is a bottom plan view showing a bottom member of the support device according to Embodiment 1 of the present invention.

The steel member 23 is such that a plurality of attachment holes 27 (fifth attachment holes) are formed in the bottom surface thereof. The attachment holes 27 are holes for fixing the vibration-proofing device 12 to the steel member 23 (the bottom member 18). FIG. 6 is a bottom plan view showing the bottom member of the support device according to Embodiment 1 of the present invention. In FIG. 6, reference numeral 27 is given to only part of the attachment holes, but the attachment holes 27 are arranged in a line at equal intervals along the longitudinal part of the steel members 23 (in the longitudinal direction). FIG. 6 shows the case where the attachment holes 27 are arranged in two lines at a prescribed interval.

The reinforcement member 24 has, for example, a plate-like shape. The reinforcement member 24 is fixed to the steel member 23 by welding. The reinforcement member 24 is arranged in an upright condition in a space formed on the inner side of the steel member 23. The reinforcement member 24 is arranged in a position at a prescribed distance from the attachment holes 25 and 26 so that the reinforcement member 24 does not cause a hindrance to the fixing of the top member 20.

The configuration of the bottom member 18 (for example, the shape of the steel member 23 and the shape and attachment position of the reinforcement member 24) is not limited to the foregoing. The bottom member 18 may have another configuration so long as the bottom member 18 has a necessary function.

The bottom member 19 (the third member) has a configuration which is line-symmetric with respect to the bottom member 18. The bottom member 19 is arranged at the same height as the bottom member 18 and parallel to the bottom member 18. The bottom member 19 is composed of, for example, a long steel member 28 and a plurality of reinforcement members 29.

The steel member 28 has, for example, a channel shape in section and opens sideways. The steel member 28 is such that a plurality of attachment holes 30 (second attachment holes) are formed in the top surface thereof. The attachment holes 30 are holes for fixing the top member 20 to the steel member 28 (the bottom member 19). In FIG. 2, reference numeral 30 is given to only part of the attachment holes, but the attachment holes 30 are arranged in a line at equal intervals along the longitudinal part of the steel members 28 (in the longitudinal direction). The line of the attachment holes 30 formed in the steel member 28 is arranged parallel to the line of the attachment holes 25 formed in the steel member 23. The steel member 28 is such that a plurality of attachment holes 31 are formed in the top surface thereof. Also the attachment holes 31 are holes for fixing the top member 20 to the steel member 28. The attachment holes 31 are arranged in a line at equal intervals along the longitudinal part of the steel member 28. The line of the attachment holes 31 is arranged parallel to the line of the attachment holes 30.

The steel member 28 is such that a plurality of attachment holes 32 (sixth attachment holes) are formed in the bottom surface thereof. The attachment holes 32 are holes for fixing the vibration-proofing device 12 to the steel member 28 (the bottom member 19). In FIG. 6, reference numeral 32 is given to only part of the attachment holes, but the attachment holes 32 are arranged in a line at equal intervals along the longitudinal part of the steel members 28 (in the longitudinal direction). The line of the attachment holes 32 formed in the steel member 28 is arranged parallel to the line of the attachment holes 27 formed in the steel member 23. FIG. 6 shows the case where the attachment holes 32 are arranged in two lines at a prescribed interval (for example, the same interval as the lines of the attachment holes 27).

The reinforcement member 29 has, for example, a plate-like shape. The reinforcement member 29 is fixed to the steel member 28 by welding. The reinforcement member 29 is arranged in an upright condition in a space formed on the inner side of the steel member 28. The reinforcement member 29 is arranged in a position at a prescribed distance from the attachment holes 30 and 31 so that the reinforcement member 29 does not cause a hindrance to the fixing of the top member 20.

The configuration of the bottom member 19 (for example, the shape of the steel member 28 and the shape and attachment position of the reinforcement member 29) is not limited to the foregoing. The bottom member 19 may have another configuration so long as the bottom member 19 has a necessary function.

The top member 20 (the first member) is a part to which the fraction machine 7 is fixed. The top surface of the top member 20 forms a fixing surface for fixing the traction machine 7. The top member 20 is fixed to both of the bottom members 18 and 19.

Figure 7:
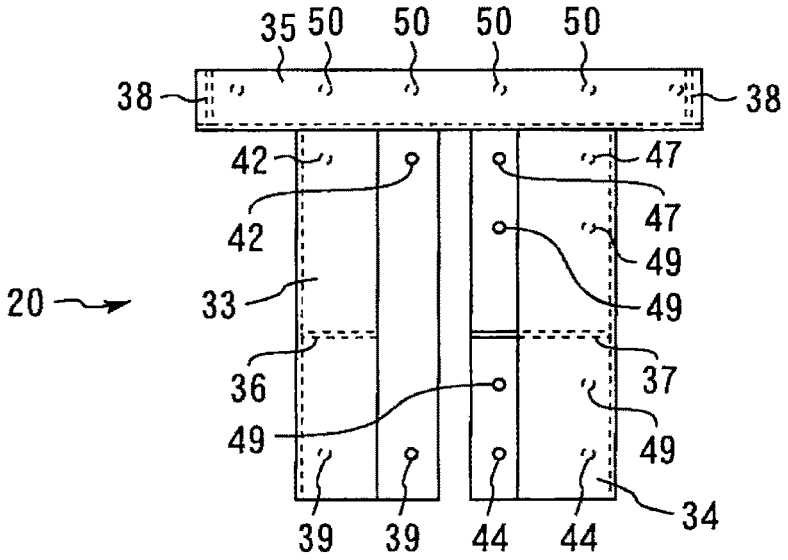
FIG. 7 is a plan view showing a top member of the support device according to Embodiment 1 of the present invention.

FIG. 7 is a plan view showing the top member of the support device according to Embodiment 1 of the present invention.

The top member 20 is such that, for example, steel members 33, 34, 35 and plate-like reinforcement members 36, 37, 38 are integrally fixed together by welding.

The steel member 33 has, for example, a channel shape (the shape of the letter J) in section and opens sideways. The steel member 33 is arranged so that an angle formed by the longitudinal part thereof and the longitudinal part of the bottom member 18 (the longitudinal part of the bottom member 19) becomes approximately 90 degrees. The steel member 33 is arranged in such a manner as to be placed on both the top surface of the bottom member 18 and the top surface of the bottom member 19.

The steel member 33 is such that a plurality of attachment holes 39 are formed in the bottom surface of one end thereof. The attachment holes 39 are holes for fixing the top member 20 to the steel member 23 (the bottom member 18). The attachment holes 39 are formed at the same intervals as the attachment holes 25. Reference numeral 40 denotes a bolt for fixing one end of the steel member 33 to the steel member 23. The steel member 33 is such that one end thereof is placed on the top surface of the steel member 23. The bolt 40 passes through the attachment hole 39 and the attachment hole 25. The bolt 40 is such that the threaded portion thereof is fastened to a nut 41 (a member in which an internal thread is formed) below the attachment hole 25.

The steel member 33 is such that a plurality of attachment holes 42 are formed in the bottom surface of the other end thereof. The attachment holes 42 are holes for fixing the top member 20 to the steel member 28 (the bottom member 19). The attachment holes 42 are formed at the same intervals as the attachment holes 30. Reference numeral 43 denotes a bolt for fixing the other end of the steel member 33 to the steel member 28. The steel member 33 is such that the other end thereof is placed on the top surface of the steel member 28. The bolt 43 passes through the attachment hole 42 and the attachment hole 30. The bolt 43 is such that the threaded portion thereof is fastened to a nut (not shown) below the attachment hole 30.

The reinforcement member 36 is fixed to a middle portion of the steel member 33. The reinforcement member 36 is arranged in an upright condition in a space formed on the inner side of the steel member 33.

The steel member 34 has, for example, a channel shape (the shape of the letter J) in section and opens sideways. The steel member 34 is arranged parallel to the steel member 33. That is, the longitudinal part of the steel member 34 and the longitudinal part of the bottom member 18 (the longitudinal part of the bottom member 19) almost form a right angle. The steel member 34 is arranged in such a manner as to be placed on both the top surface of the bottom member 18 and the top surface of the bottom member 19.

The steel member 34 is such that a plurality of attachment holes 44 are formed in the bottom surface of one end thereof. The attachment holes 44 are holes for fixing the top member 20 to the steel member 23 (the bottom member 18). The attachment holes 44 are formed at the same intervals as the attachment holes 25. Reference numeral 45 denotes a bolt for fixing one end of the steel member 34 to the steel member 23. The steel member 34 is such that one end thereof is placed on the top surface of the steel member 23. The bolt 45 passes through the attachment hole 44 and the attachment hole 25. The bolt 45 is such that the threaded portion thereof is fastened to a nut 46 (a member in which an internal thread is formed) below the attachment hole 25.

In this embodiment, the first bolts in Claims are composed of the bolts 40 and 45.

The steel member 34 is such that a plurality of attachment holes 47 are formed in the bottom surface of the other end thereof. The attachment holes 47 are holes for fixing the top member 20 to the steel member 28 (the bottom member 19). The attachment holes 47 are formed at the same intervals as the attachment holes 30. Reference numeral 48 denotes a bolt for fixing the other end of the steel member 34 to the steel member 28. The steel member 34 is such that the other end thereof is placed on the top surface of the steel member 28. The bolt 48 passes through the attachment hole 47 and the attachment hole 30. The bolt 48 is such that the threaded portion thereof is fastened to a nut (not shown) below the attachment hole 30.

In this embodiment, the second bolts in Claims are composed of the bolts 43 and 48.

The steel member 34 is such that a plurality of attachment holes 49 (fourth attachment holes) are formed in the bottom surface thereof. The attachment holes 49 are holes formed in order to support the deflector sheave 10. A method of using the attachment holes 49 will be described later.

The reinforcement member 37 is fixed to a middle portion of the steel member 34. The reinforcement member 37 is arranged in an upright condition in a space formed on the inner side of the steel member 34.

The steel member 35 has, for example, a channel shape in section and opens sideways. The steel member 35 is arranged in such a manner that the longitudinal part thereof becomes parallel to the longitudinal part of the bottom member 18 (the longitudinal part of the bottom member 19). The steel member 33 is such that the other end thereof is fixed to the steel member 35 by welding. The steel member 34 is such that the other end thereof is fixed to the steel member 35 by welding.

The steel member 35 is such that a plurality of attachment holes 50 are formed in the bottom surface thereof. The attachment holes 50 are holes for fixing the top member 20 to the steel member 28 (the bottom member 19). The attachment holes 50 are formed in a line at the same intervals as the attachment holes 31. Reference numeral 51 denotes a bolt for fixing the steel member 35 to the steel member 28. The steel member 35 is arranged in such a manner as to be placed on the top surface of the steel member 28. The bolt 51 passes through the attachment hole 50 and the attachment hole 31. The bolt 51 is such that the threaded portion thereof is fastened to a nut (not shown) below the attachment hole 31.

The reinforcement member 38 is fixed to an end of the steel member 35. The reinforcement member 38 is arranged in an upright condition in a space formed on the inner side of the steel member 35.

The configuration of the top member 20 (for example, the shape of each steel member and the shape and attachment position of each reinforcement member) is not limited to the foregoing. The top member 20 may have another configuration so long as the top member 20 has a necessary function.

In the case where the top member 20 includes a plurality of steel members, the top surface (fixing surface) of the top member 20 may be formed from a plate member 52. In this case, the plate member 52 is welded and fixed to each steel member constituting the top member 20. With this configuration, it is possible to give high flatness to the fixing surface and it is possible to stably hold the traction machine 7 with prescribed horizontality.

The attachment member 21 (the fifth member) and the attachment member 22 (the fourth member) are intended for supporting the deflector sheave 10. The shaft of the deflector sheave 10 is supported by a pair of support members 53 so as to be freely rotatable. The support members 53 are fixed to the attachment members 21 and 22.

Figure 8:
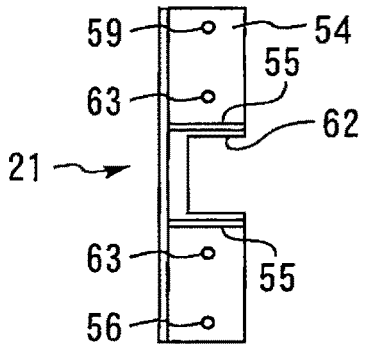
FIG. 8 is a plan view showing an attachment member of the support device according to Embodiment 1 of the present invention.

FIG. 8 is a plan view showing an attachment member of the support device according to Embodiment 1 of the present invention. FIG. 8 shows the attachment member 21.

The attachment member 21 is fixed to both of the bottom members 18 and 19. The attachment member 21 is arranged near one end of the bottom member 18 (the bottom member 19). The attachment member 21 is composed of, for example, a steel member 54 having a prescribed length and plate-like reinforcement members 55.

The steel member 54 is intended for maintaining strength at a high level and has, for example, an L-shaped section. The steel member 54 is arranged in such a manner that an angle formed by the longitudinal part thereof and the longitudinal part of the bottom member 18 (the longitudinal part of the bottom member 19) becomes approximately 90 degrees. The steel member 54 is arranged in such a manner as to be placed on both the top surface of one end of the bottom member 18 and the top surface of one end of the bottom member 19.

The steel member 54 is such that an attachment hole 56 is formed in the bottom surface of one end thereof. The attachment hole 56 is a hole for fixing the attachment member 21 to the steel member 23 (the bottom member 18). Reference numeral 57 denotes a bolt for fixing one end of the steel member 54 to the steel member 23. The steel member 54 is such that one end thereof is placed on the top surface of one end of the steel member 23. The bolt 57 passes through the attachment hole 56 and the attachment hole 25 which is arranged nearest to one end of the steel member 23. The bolt 57 is such that the threaded portion thereof is fastened to a nut 58 above the attachment hole 56.

The steel member 54 is such that an attachment hole 59 is formed in the bottom surface of the other end thereof. The attachment hole 59 is a hole for fixing the attachment member 21 to the steel member 28 (the bottom member 19). Reference numeral 60 denotes a bolt for fixing the other end of the steel member 54 to the steel member 28. The steel member 54 is such that the other end thereof is placed on the top surface of one end of the steel member 28. The bolt 60 passes through the attachment hole 59 and the attachment hole 30 which is arranged nearest to one end of the steel member 28. The bolt 60 is such that the threaded portion thereof is fastened to a nut 61 above the attachment hole 59.

The steel member 54 is such that a notched portion 62 is formed in an area thereof just above the deflector sheave 10. The notched portion 62 opens facing in the direction of a part of the main rope 6 which approaches the steel member 54 to a maximum degree. The notched portion 62 is intended for preventing the main rope 6 from coming into contact with the attachment member 21. The part of the main rope 6 ranging from the driving sheave 9 to the deflector sheave 10 passes through the notched portion 62.

In the figures, the notched portion 62 is formed outward with respect to the traction machine base 13. This is an example. In the case where the main rope 6 passes on the attachment member 22 side of the steel member 54, the notched portion 62 can be formed so as to open to the inner side by adapting to the arrangement of the main rope 6.

The steel member 54 is such that a plurality of attachment holes 63 are formed in the bottom surface of a part thereof arranged between the bottom members 18 and 19. The attachment holes 63 are holes which are used to support the deflector sheave 10. The attachment holes 63 are used to fix the support member 53 to the attachment member 21. Reference numeral 64 denotes a bolt for fixing the support member 53 to the steel member 54. The bolt 64 passes through the attachment hole 63 and the threaded portion thereof is fastened to the support member 53.

The reinforcement member 55 is fixed to the steel member 54. The reinforcement member 55 is arranged on both sides of the notched portion 62. The reinforcement member 55 can be fixed to the steel member 54 in necessary number so as to adapt to the strength of the steel member 54. For example, if sufficient strength is ensured with only the steel member 54, it is not always necessary to provide the reinforcement member 55. In this case, the steel member 54 may be formed from a flat plate with an increased thickness in order to ensure sufficient strength.

Figure 9:
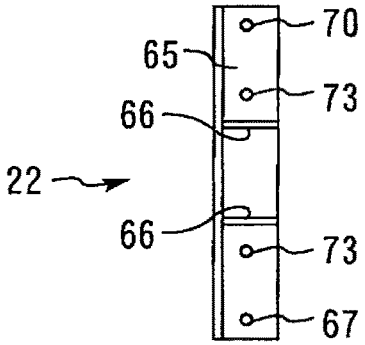
FIG. 9 is a plan view showing an attachment member of the support device according to Embodiment 1 of the present invention.

FIG. 9 is a plan view showing an attachment member of the support device according to Embodiment 1 of the present invention. FIG. 9 shows the attachment member 22.

The attachment member 22 is fixed to both of the bottom members 18 and 19. The attachment member 22 is arranged parallel to the attachment member 21 and the steel member 34 of the top member 20. The attachment member 22 is arranged on the top member 20 side of the attachment member 21. The attachment member 22 is composed of, for example, a steel member 65 having a prescribed length and plate-like reinforcement members 66.

The steel member 65 is intended for maintaining strength at a high level and has, for example, an L-shaped section. The steel member 65 is arranged in such a manner that an angle formed by the longitudinal part thereof and the longitudinal part of the bottom member 18 (the longitudinal part of the bottom member 19) becomes approximately 90 degrees. The steel member 65 is arranged in such a manner as to be placed on both the top surface of the bottom member 18 and the top surface of the bottom member 19.

The steel member 65 is such that an attachment hole 67 is formed in the bottom surface of one end thereof. The attachment hole 67 is a hole for fixing the attachment member 22 to the steel member 23 (the bottom member 18). Reference numeral 68 denotes a bolt (a third bolt) for fixing one end of the steel member 65 to the steel member 23. The steel member 65 is such that one end thereof is placed on the top surface of the steel member 23. The bolt 68 passes through the attachment hole 25 and the attachment hole 67. The bolt 68 is such that the threaded portion thereof is fastened to a nut 69 above the attachment hole 67.

The steel member 65 is such that an attachment hole 70 is formed in the bottom surface of the other end thereof. The attachment hole 70 is a hole for fixing the attachment member 22 to the steel member 28 (the bottom member 19). Reference numeral 71 denotes a bolt (a fourth bolt) for fixing the other end of the steel member 65 to the steel member 28. The steel member 65 is such that the other end thereof is placed on the top surface of the steel member 28. The bolt 71 passes through the attachment hole 30 and the attachment hole 70. The bolt 71 is such that the threaded portion thereof is fastened to a nut 72 above the attachment hole 70.

The steel member 65 is such that a plurality of attachment holes 73 (third attachment holes) are formed in the bottom surface of a part thereof arranged between the bottom members 18 and 19. The attachment holes 73 are holes which are used to support the deflector sheave 10. Specifically, the attachment holes 73 are used to fix the support member 53 to the attachment member 22. Reference numeral 74 denotes a bolt for fixing the support member 53 to the steel member 65. The bolt 74 passes through the attachment hole 73 and the threaded portion thereof is fastened to the support member 53.

The reinforcement member 66 is fixed to the steel member 65. The reinforcement member 66 can be fixed to the steel member 65 in necessary number so as to adapt to the strength of the steel member 65. For example, if sufficient strength is ensured with only the steel member 65, it is not always necessary to provide the reinforcement member 66. In this case, the steel member 65 may be formed from a flat plate with an increased thickness in order to ensure sufficient strength.

As described above, the traction machine base 13 is fixed to the machine foundation 11 via the vibration-proofing device 12. For example, two vibration-proofing devices 12 are provided on the top surface of the steel member 14 of the machine foundation 11. The vibration-proofing devices 12 are fixed to the steel member 14 using bolts or clips. Similarly, for example, two vibration-proofing devices 12 are provided on the top surface of the steel member 15 of the machine foundation 11. The vibration-proofing devices 12 are fixed to the steel member 15 using bolts or clips. The vibration-proofing devices 12 are arranged at a prescribed interval in such a manner as to adapt to the suspension position of the car 4 and the suspension position of the counterweight 5.

The bottom member 18 of the fraction machine base 13 is provided in the vibration-proofing device 12 provided on the top surface of the steel member 14. The bottom member 18 is arranged parallel to the steel member 14 above the steel member 14. The bottom member 18 is placed on the top surface of the vibration-proofing device 12 provided on the steel member 14. The vibration-proofing device 12 includes, for example, a screw bar 75 which protrudes upward. The screw bar 75 of the vibration-proofing device 12 provided in the steel member 14 passes through the attachment hole 27. A nut 76 is fastened to the screw bar 75 above the attachment hole 27.

The bottom member 19 of the traction machine base 13 is provided in the vibration-proofing device 12 provided on the top surface of the steel member 15. The bottom member 19 is arranged parallel to the steel member 15 above the steel member 15. The bottom member 19 is placed on the top surface of the vibration-proofing device 12 provided on the steel member 15. The screw bar 75 of the vibration-proofing device 12 provided in the steel member 15 passes through the attachment hole 32. A nut 77 is fastened to the screw bar 75 above the attachment hole 32.

In the support device 8 having the above-described configuration, the top member 20 of the traction machine base 13 is laid in a bridging manner between the bottom members 18 and 19. For this reason, it is possible to transmit the force received from the traction machine 7 to both the steel members 14 and 15 of the machine foundation 11 via the top member 20 and the bottom members 18 and 19. Similarly, the attachment members 21 and 22 of the traction machine base 13 are laid in a bridging manner between the bottom members 18 and 19. For this reason, it is possible to transmit the force received from the deflector sheave 10 to both the steel members 14 and 15 of the machine foundation 11 via the attachment members 21 and 22 and the bottom members 18 and 19. It is possible to transmit the forces from the traction machine 7 and the deflector sheave 10 to the building side in a distributed manner.

In an elevator, at the start of the operation of the car 4, a tension variation occurs in the main rope 6. This tension variation can become the cause of vibration of the traction machine 7. Also in the traction machine 7 itself, a factor responsible for the occurrence of vibration exists. For example, a torque ripple of a motor for driving the driving sheave 9 causes vibration to occur in the traction machine 7. In the case where the traction machine 7 includes a reduction gear, the backlash of the reduction gear causes vibration to occur in the traction machine 7. In the support device 8, the traction machine base 13 is provided in the machine foundation 11 via the vibration-proofing device 12. For this reason, it is possible to appropriately reduce the vibration transmitted from the traction machine 7 to the building via a combination (a spring system and a mass system) of the traction machine base 13 and the vibration-proofing device 12

Next, a description will be given of a method of setting the traction machine 7 in an appropriate position.

The horizontal distance between the suspension position of the car 4 and the suspension position of the counterweight 5 (hereinafter referred to as the "CC size") differs from one elevator type to another. In the renewal of an elevator, it is necessary to appropriately arrange the (new) traction machine 7 and deflector sheave 10 so as to adapt to the CC size of the existing elevator.

Figure 10:
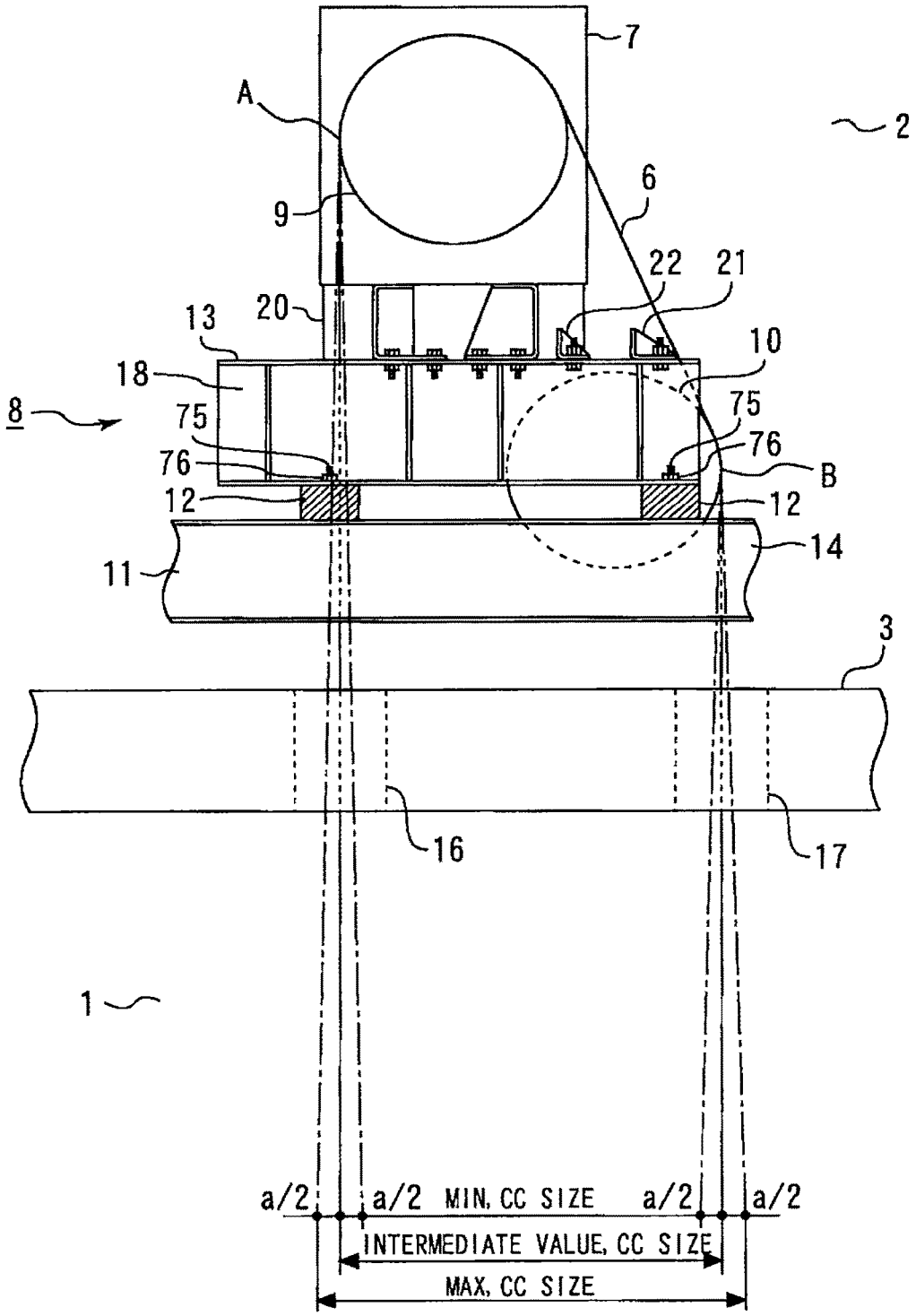
FIG. 10 is a diagram to explain the function of the support device according to Embodiment 1 of the present invention.
Figure 11:
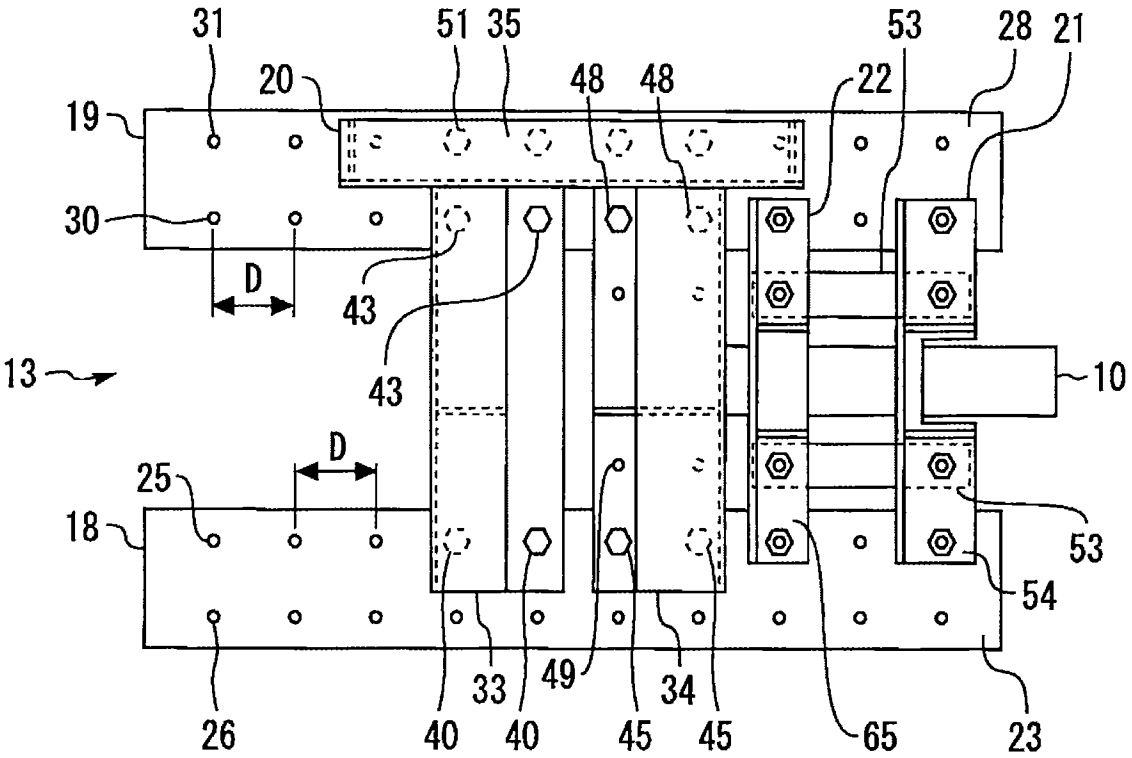
FIG. 11 is a plan view of a traction machine base shown in FIG. 10.

FIG. 10 is a diagram to explain the function of the support device according to Embodiment 1 of the present invention. FIG. 10 shows the configuration obtained when the traction machine 7 is installed in an elevator having a shorter CC size than the elevator shown in FIG. 1. FIG. 11 is a plan view of the traction machine base shown in FIG. 10.

A large number of attachment holes 25 for attaching the top member 20 are formed in the bottom member 18 of the traction machine base 13. For example, the attachment holes 25 are formed in the top surface of the bottom member 18 each at a distance of D. The attachment holes 39 and 44 are formed in the top member 20 in a line so that the distance between adjacent attachment holes becomes D. For this reason, by using the bolts 40 and 45, it is possible to fix (one end side of) the top member 20 in an arbitrary position each at the distance of D with respect to the bottom member 18.

A large number of attachment holes 30 for attaching the top member 20 are formed in the bottom member 19 of the traction machine base 13. For example, the attachment holes 30 are formed in the top surface of the bottom member 19 each at the distance of D. The attachment holes 42 and 47 are formed in the top member 20 in a line so that the distance between adjacent attachment holes becomes D. For this reason, by using the bolts 43 and 48, it is possible to fix (the other end side of) the top member 20 in an arbitrary position each at the distance of D with respect to the bottom member 19.

By appropriately adjusting the positions of the bottom members 18 and 19, it is possible to fix the top member 20 in an arbitrary position each at the distance of D with respect to the bottom members 18 and 19. For this reason, in the case of the renewal of an elevator, the top member 20 can be fixed to the bottom members 18 and 19 by appropriately selecting the attachment holes 25 and 30 which are to be used so that the horizontal direction between point A and point B shown in FIG. 10 becomes nearest to the CC size of the elevator. Point A is the point at which the main rope 6 departs from the driving sheave 9 toward the car 4. Point B is the point at which the main rope 6 departs from the deflector sheave 10 toward the counterweight 5.

The rope hole 16 which is formed in the floor portion 3 is formed somewhat large beforehand in consideration of installation errors and the like. For this reason, even when the main rope 6 passing through the rope hole 16 inclines a little, no problem occurs in the operation of an elevator. The same applies to also the rope hole 17. That is, for elevators whose CC size is in a given range, the top member 20 is attached to the bottom members 18 and 19 using the same attachment holes 25 and 30.

For example, the attachment position of the traction machine 7 is set as follows.

(i) Case where $\alpha<\text{CC Size}\leq\alpha+D$

The top member 20 is fixed so that the traction machine 7 and the deflector sheave 10 approach nearest to each other. $\alpha$ is a minimum set value. For the minimum set value $\alpha$, an appropriate value is set beforehand according to the type of an elevator whose CC size is the smallest. At this time, the horizontal distance between point A and point B shown in FIG. 10 is, for example, $\alpha+D/2$.

(ii) Case where $\alpha+D<\text{CC Size}\leq\alpha+2D$

The top member 20 is fixed in a position at which the traction machine 7 is horizontally away from the deflector sheave 10 further by the distance of D compared to the case of (i). At this time, the horizontal distance between point A and point B shown in FIG. 10 is, for example, $\alpha+3D/2$.

(iii) Case where $\alpha+2D<\text{CC Size}\leq\alpha+3D$

The top member 20 is fixed in a position at which the traction machine 7 is horizontally away from the deflector sheave 10 further by the distance of D compared to the case of (ii). At this time, the horizontal distance between point A and point B shown in FIG. 10 is, for example, $\alpha+5D/2$.

Also in the case where the CC size is larger than $\alpha+3D$, the top member 20 is fixed under the same conditions as described above.

The distance D, which is the spacing between the attachment holes 25 and between the attachment holes 30, can be set at appropriate values by investigating the present condition of the diameter of the rope hole 16 and the present condition of the CC size of an existing elevator and in consideration of the strength necessary for the traction machine base 13. By setting the minimum set value $\alpha$ and the distance D at appropriate values, it becomes possible to apply the traction machine base 13 to the CC sizes of almost all types of elevators.

The foregoing is a description given in the case where the attachment holes 25 and 30 are each formed at equal intervals. It is needless to say that the attachment holes 25 and 30 may be formed at unequal intervals.

The number of the attachment holes 25 is larger than the total number of the attachment holes 39 and 44. For this reason, the total number of the bolts 40 and 45 is smaller than the number of the attachment holes 25. Even when the top member 20 is appropriately fixed to the bottom member 18, bolts are not attached to part of the attachment holes 25. Part of the attachment holes 25 are kept open. Similarly, the number of the attachment holes 30 is larger than the total number of the attachment holes 42 and 47. For this reason, the total number of the bolts 43 and 48 is smaller than the number of the attachment holes 30. Even when the top member 20 is appropriately fixed to the bottom member 19, bolts are not attached to part of the attachment holes 30. Part of the attachment holes 30 are kept open.

The traction machine 7 which is fixed to the fixing surface of the top member 20 is arranged to face in the same direction at the same height even when through the use of any of the attachment holes 25 and 30, one end side of the top member 20 is fixed to the bottom member 18 and the other end side is fixed to the bottom member 19. Here, "face in the same direction" means that the rotational axis of the driving sheave 9 constituting the traction machine 7 faces in the same direction (is arranged parallel). That is, by attaching the top member 20 to the bottom members 18 and 19 using the attachment holes 25 and 30, it is possible to change the arrangement of the traction machine 7 in such a manner that the traction machine 7 performs parallel movement.

Figure 12:
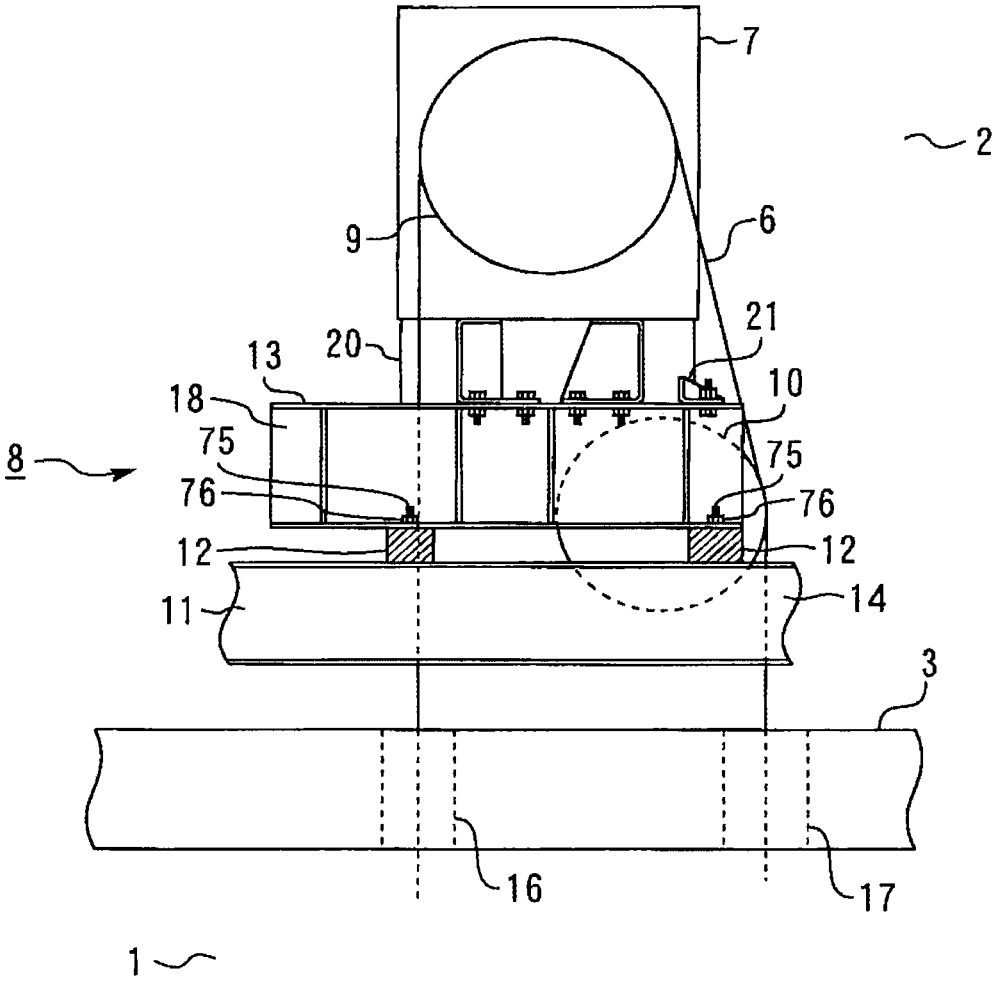
FIG. 12 is a diagram to explain the function of the support device according to Embodiment 1 of the present invention.
Figure 13:
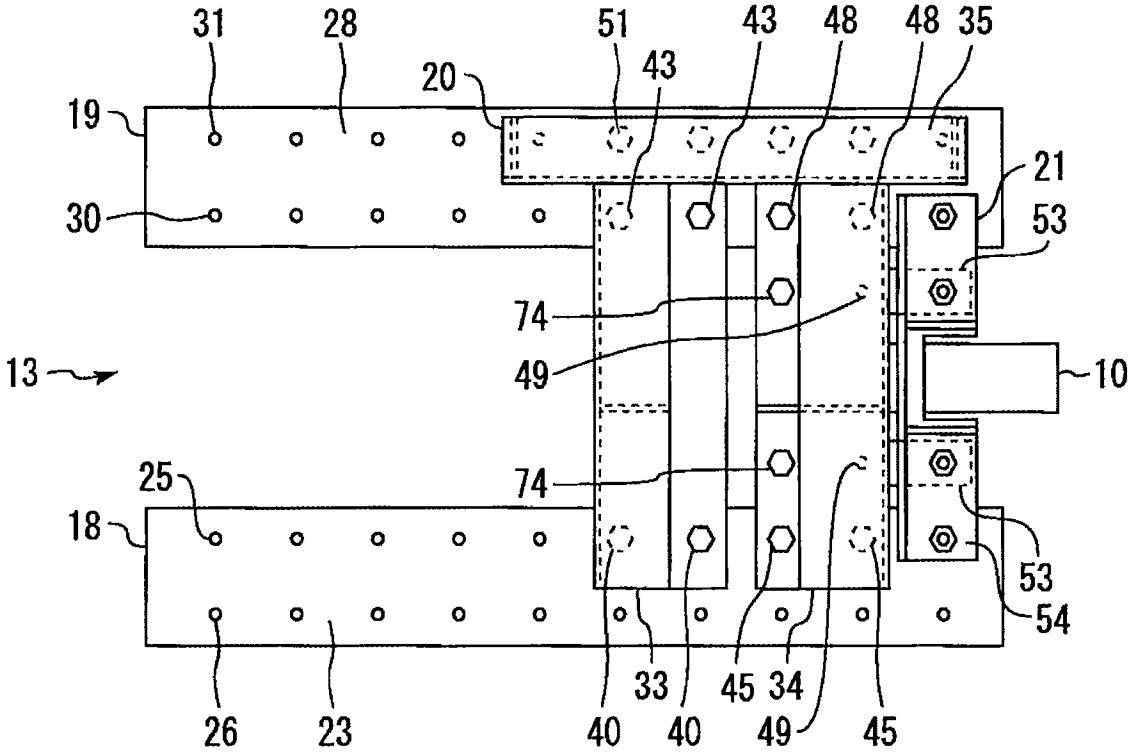
FIG. 13 is a plan view of the traction machine base shown in FIG. 12.

FIG. 12 is a diagram to explain the function of the support device according to Embodiment 1 of the present invention. FIG. 12 shows the configuration obtained when the traction machine 7 is installed in an elevator having an even shorter CC size than the elevator shown in FIG. 10. Specifically, FIG. 12 shows the configuration obtained when the traction machine 7 is caused to approach the deflector sheave 10 to a maximum degree. FIG. 13 is a plan view of the traction machine base shown in FIG. 12.

In the configuration shown in FIGS. 12 and 13, the deflector sheave 10 is supported by the top member 20 without using the attachment member 22. The attachment holes 49 of the top member 20 are formed to correspond to the attachment holes 73 of the attachment member 22. When the top member 20 is fixed so that the steel member 34 is arranged in the attachment position of the attachment member 22, the attachment holes 49 are arranged in the positions where the attachment holes 73 are arranged in FIG. 2 and FIG. 11. The bolt 74 passes through the attachment hole 49 and the threaded portion thereof is fastened to the support member 53. Because of this configuration it is possible to arrange the traction machine 7 in a position very near to the deflector sheave 10.

In the case where an existing machine foundation 11 is used as it is in the renewal of an elevator, it is necessary to fix the traction machine base 13 to the machine foundation 11 via the vibration-proofing device 12 after the driving sheave 9 is appropriately arranged in such a manner as to adapt to the suspension position of the car 4 and the suspension position of the counterweight 5.

FIGS. 14 to 17 are diagrams to explain the function of the support device according to Embodiment 1 of the present invention.

The vibration-proofing device 12 is provided on the top surface of the steel member 14 and the top surface of the steel member 15. The distance between the vibration-proofing device 12 provided on the steel member 14 and the vibration-proofing device 12 provided on the steel member 15 is determined by the distance between the steel member 14 and the steel member 15.

The attachment holes 27 are formed in two lines in the bottom surface of the bottom member 18. Similarly, the attachment holes 32 are formed in two lines in the bottom surface of the bottom member 19. For this reason, by changing the attachment positions of the vibration-proofing devices 12 in the bottom members 18 and 19, as shown in FIGS. 14 to 17, it is possible to appropriately arrange the traction machine 7 to adapt to four kinds of machine foundation 11.

The position (spacing) of the vibration-proofing device 12 attached to the steel member 14 can be adapted to the suspension position of the car 4 and the suspension position of the counterweight 5. The same applies to also the position (spacing) of the vibration-proofing device 12 attached to the steel member 15.

Figure 14:
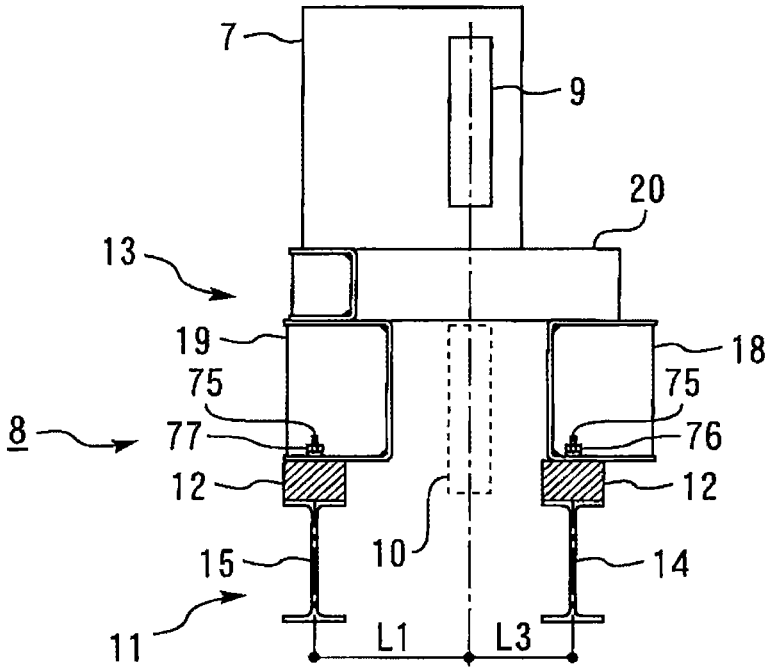
FIG. 14 is a diagram to explain the function of the support device according to Embodiment 1 of the present invention.
Figure 15:
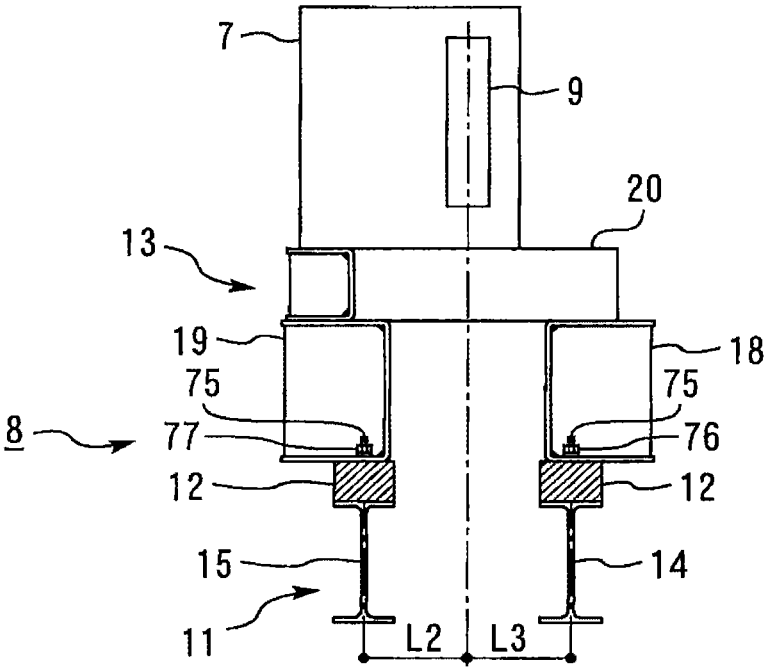
FIG. 15 is a diagram to explain the function of the support device according to Embodiment 1 of the present invention.
Figure 16:
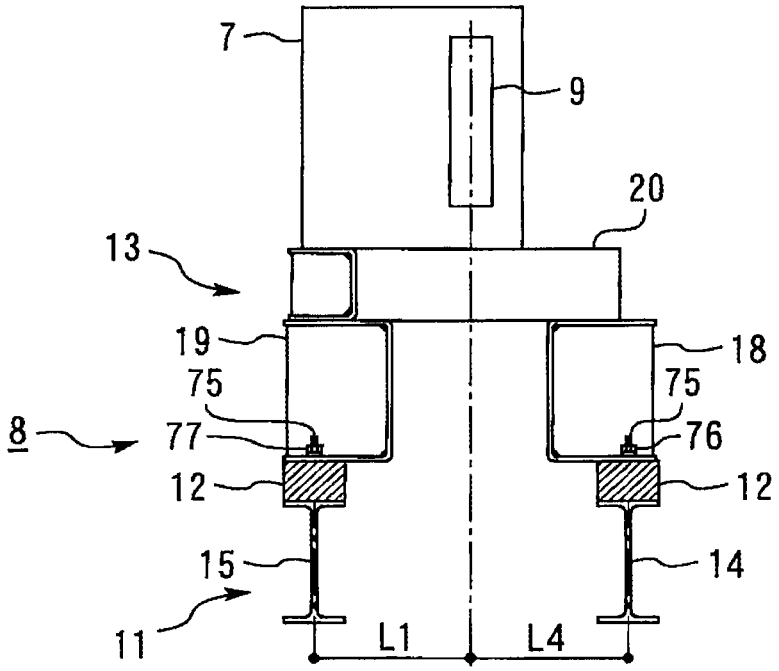
FIG. 16 is a diagram to explain the function of the support device according to Embodiment 1 of the present invention.
Figure 17:
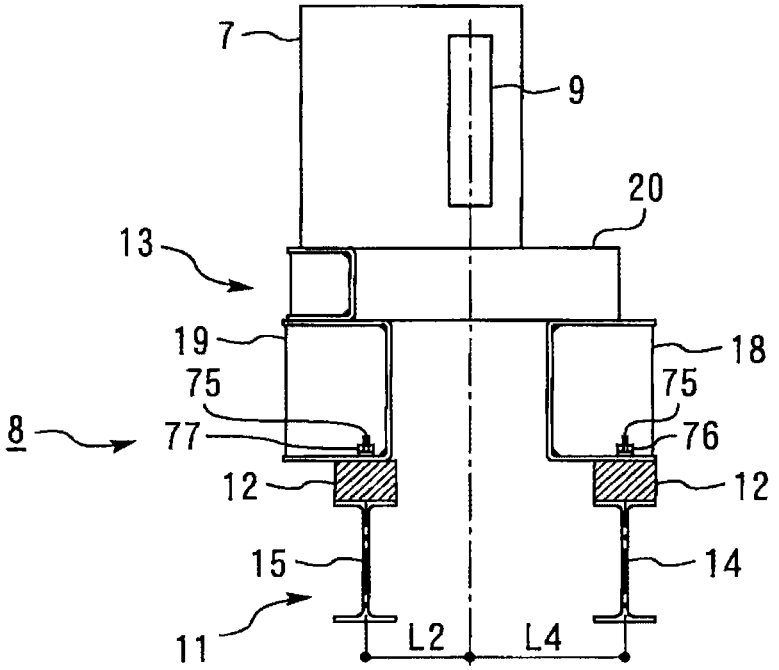
FIG. 17 is a diagram to explain the function of the support device according to Embodiment 1 of the present invention.

For example, in the example shown in FIG. 14, the vibration-proofing device 12 provided in the steel member 14 is fixed to the bottom member 18 using the attachment hole 27 arranged on the inner side. The vibration-proofing device 12 provided in the steel member 15 is fixed to the bottom member 19 using the attachment hole 32 arranged on the outer side. In the example shown in FIG. 17, the vibration-proofing device 12 provided in the steel member 14 is fixed to the bottom member 18 using the attachment hole 27 arranged on the outer side. The vibration-proofing device 12 provided in the steel member 15 is fixed to the bottom member 19 using the attachment hole 32 arranged on the inner side.

By forming the attachment holes 27 and the attachment holes 32 are each in two lines, it becomes possible to apply the traction machine base 13 to elevators of almost all types.

As described above, the traction machine base 13 can be applied to various elevators having different CC sizes and configurations of the machine foundation 11. For this reason, it is possible to substantially reduce the kinds of members and parts which are fabricated and stored. It is possible to reduce costs for fabrication and storage, and it becomes easy to control these members and parts. Because common utilization of many of the members and parts is possible, conventional problems with a production method by which semi-processed products are produced in advance do not occur even when this production method is adopted to reduce a construction period.

Figure 18:
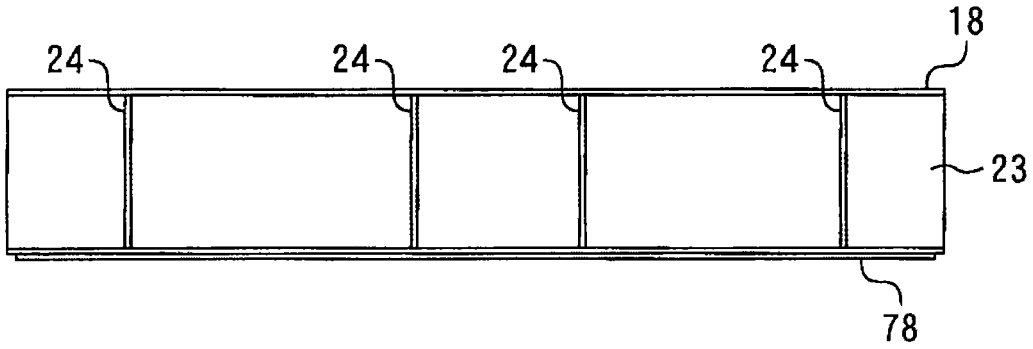
FIG. 18 is a front view showing another example of the bottom member of the support device according to Embodiment 1 of the present invention.
Figure 19:
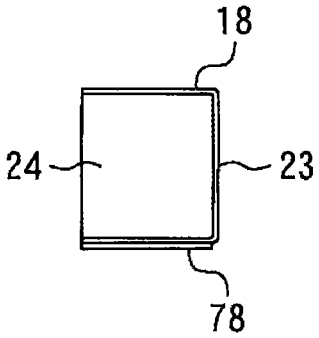
FIG. 19 is a side view of the bottom member shown in FIG. 18.

In the traction machine base 13 of this embodiment, a large number of holes are formed in the bottom member 18. In the case where prescribed strength cannot be ensured for the bottom member 18 with only the steel member 23 and the reinforcement members 24, other reinforcement members may be added. FIG. 18 is a front view showing another example of the bottom member of the support device according to Embodiment 1 of the present invention. FIG. 19 is a side view of the bottom member shown in FIG. 18. In the bottom member 18 shown in FIGS. 18 and 19, a bottom reinforcement member 78 is fixed to the bottom surface of the steel member 23 in order to ensure prescribed strength. By including the bottom reinforcement member 78, it is possible to increase rigidity by increasing the modulus of section of the bottom member 18.

The same applies to also the bottom member 19.

For the traction machine base 13, the bolts which are used (in particular, the bolts 40 and 45 which compose the first bolts and the bolts 43 and 48 which compose the second bolts) may be bonded and fixed to members in which internal threads are formed (nuts and the like) with a prescribed adhesive. For example, after an adhesive is filled in the nut 41, the bolt 40 is fastened to the nut 41. Microvibrations from the traction machine 7 act on the traction machine base 13 for a long period. By fixing the bolt by bonding, it is possible to prevent the bolt from becoming loose due to vibrations. Even if the adhesive deteriorates and the bolt becomes loose, cracks occurring in the adhesive can be visually detected with ease.

A level raising bed may be added to the traction machine base 13 in order to obtain sufficient traction performance. When the traction machine 7 is arranged in a position which is horizontally away from the deflector sheave 10, the distance over which the main rope 6 is wound on the driving sheave (the winding length) becomes short. When this distance becomes short, it might become impossible to obtain a driving force sufficient for driving the car 4. The level raising bed is provided between the top member 20 of the traction machine base 13 and the traction machine 7. By installing the level raising bed, it becomes possible to raise the position of the traction machine 7 (with respect to the deflector sheave 10). As a result of this, it is possible to increase the winding length. Accordingly, it becomes possible to obtain sufficient traction performance.

Even in the case where the traction machine 7 is arranged in a position close to the deflector sheave 10, the level raising bed may be added to the traction machine base 13. Even in this case, it is possible to raise the position of the traction machine 7 (with respect to the deflector sheave 10), and it is possible to increase the winding length. However, in the case where sufficient traction performance can be obtained without using the level raising bed, it is not necessary to add the level raising bed to the traction machine base 13. With this configuration, it is possible to reduce the size of the support device 8.

In the traction machine base 13 of this embodiment, the attachment holes 25 and 26 are formed in two lines in the top surface of the bottom member 18. Similarly, the attachment holes 30 and 31 are formed in two lines in the top surface of the bottom member 19. For this reason, by using members having line symmetry with respect to the top member 20, it is possible to attach the traction machine 7 in the direction opposite to the traction machine base 13. In this case, among the above-described members, a steel member corresponding to the steel member 35 is fixed to the bottom member 18 using the attachment holes 26.

By forming the attachment holes 49 in the steel member 33 and ensuring the strength for supporting the deflector sheave 10 for the steel member 33, it is also possible to attach the traction machine 7 in both directions which the traction machine 7 faces using the same member (the top member 20).

Figure 20:
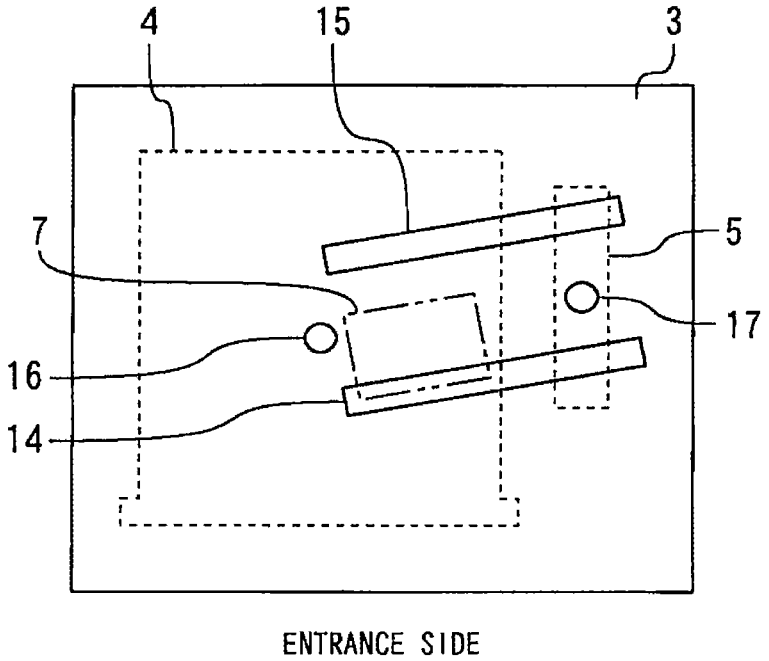
FIG. 20 is a plan view showing an example of arrangement of the support device according to Embodiment 1 of the present invention.
Figure 21:
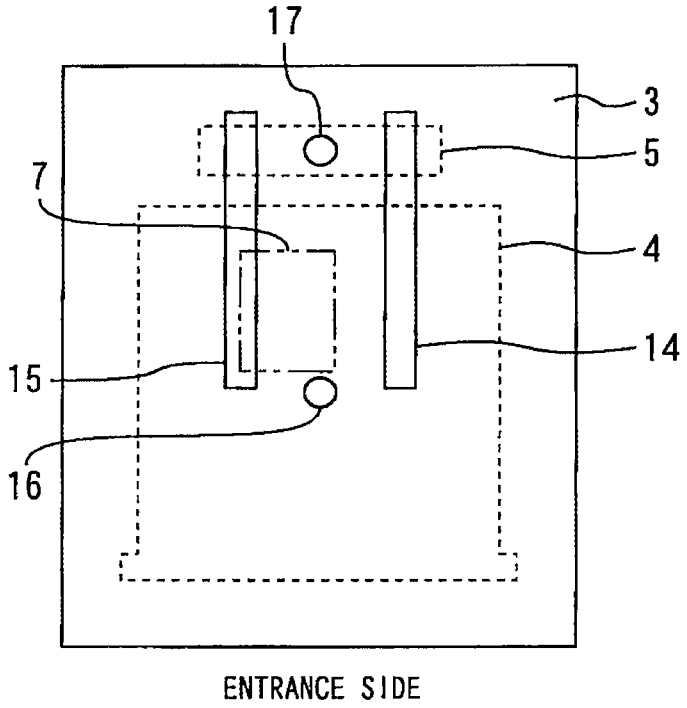
FIG. 21 is a plan view showing an example of arrangement of the support device according to Embodiment 1 of the present invention.
Figure 22:
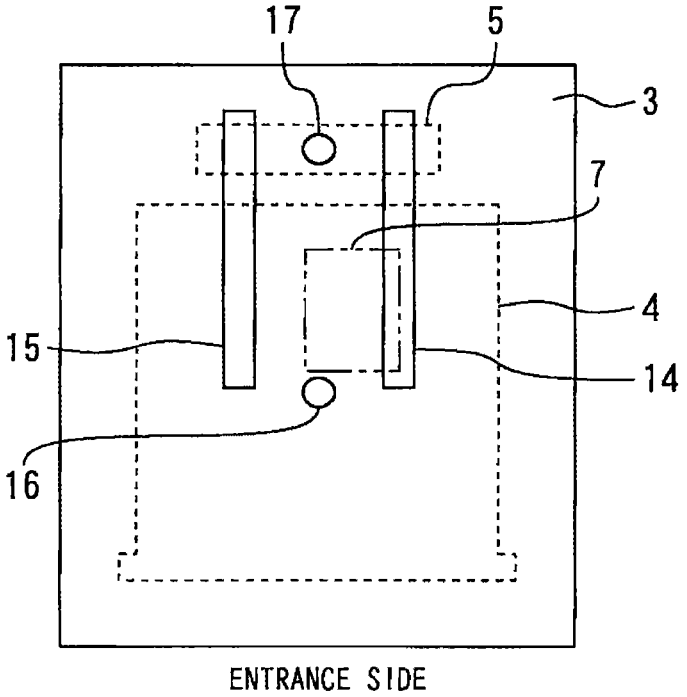
FIG. 22 is a plan view showing an example of arrangement of the support device according to Embodiment 1 of the present invention.

FIGS. 20 to 22 are plan views showing examples of arrangement of the support device according to Embodiment 1 of the present invention. FIG. 20 shows an example of arrangement in the case where the counterweight 5 passes between the car 4 and a shaft, wall on the other side. FIGS. 21 and 22 show examples of arrangement in the case where the counterweight 5 passes between the car 4 and a shaft wall on the back side. With the traction machine base 13 having this configuration, the present invention can be applied to various elevators regardless of the position of the counterweight 5 and the direction in which the traction machine 7 faces.

Lastly, a concrete description will be given of a procedure for the renewal of an existing elevator.

As described above, in the renewal of an elevator, an existing car 4, an existing counterweight 5, and an existing machine foundation 11 are often used as they are. In the case where an existing machine foundation 11 is used as it is, first, the vibration-proofing devices 12 are temporarily fixed to the steel members 14 and 15 using clips or bolts. Next, the deflector sheave 10 is placed between the vibration-proofing device 12 temporarily fixed to the steel member 14 and the vibration-proofing device 12 temporarily fixed to the steel member 15.

The top member 20 is stored, with each steel member, each reinforcement member, and the plate member 52 integrally fixed thereto by welding. The top member 20 is fixed using bolts between the bottom members 18 and 19 in such a manner as to adapt to the CC size of the elevator which is to be renovated. The traction machine base 13 is required to provide high accuracy (horizontal accuracy and the like) for attaching the traction machine 7. For this reason, the assembling of the traction machine base 13 is performed in a well-equipped shop.

A traction machine base 13 which has been integrally assembled is carried to an installation site of the elevator. In the site, the traction machine 7 is attached to the traction machine base 13. The traction machine base 13 to which the traction machine 7 is attached is lifted by a lifting device (for example, a chain block) and placed on the vibration-proofing devices 12 temporarily fixed to the machine foundation 11. The deflector sheave 10 is fixed to the traction machine base 13. After the vibration-proofing devices 12 are fixed to the traction machine base 13, position adjustments of the traction machine 7 are made and the vibration-proofing devices 12 are fixed to the machine foundation 11.

By adopting this procedure, it is possible to handle the traction machine base 13 and the traction machine 7 as an integral structure. It is possible to improve the operation efficiency in performing lifting and position adjustments. The work becomes easy because fine adjustments made in the installation of the traction machine 7 can be performed collectively in the vibration-proofing device 12.

INDUSTRIAL APPLICABILITY

The present invention can be applied to an elevator device in which a car is driven by a traction machine.

REFERENCE SIGNS LIST

1 shaft
2 machine room
3 floor portion
4 car
5 counterweight
6 main rope
7 traction machine
8 support device
9 driving sheave
10 deflector sheave
11 machine foundation
12 vibration-proofing device
13 traction machine base
14, 15, 23, 28, 33, 34, 35, 54, 65 steel member
16, 17 rope hole
18, 19 bottom member
20 top member
21, 22 attachment member
24, 29, 36, 37, 38, 55, 66 reinforcement member
25, 26, 27, 30, 31, 32, 39, 42, 44, 47, 49, 50, 56, 59, 63, 67, 70, 73 attachment hole
40, 43, 45, 48, 51, 57, 60, 64, 68, 71, 74 bolt
41, 46, 58, 61, 69, 72, 76, 77 nut
52 plate member
53 support member
62 notched portion
75 screw bar
78 bottom reinforcement member

The invention claimed is:

1. A traction machine base of an elevator, comprising:

a first member for supporting an elevator traction machine, the traction machine having a driving sheave on which a main rope is wound;

a second member in which a plurality of first attachment holes for fixing the first member are formed and the plurality of first attachment holes are arranged in a line in a first direction;

a third member in which a plurality of second attachment holes for fixing the first member are formed and the plurality of second attachment holes are arranged in a line in the first direction;

first bolts which fix the first member to the second member, each of the first bolts passing through one of the first attachment holes; and second bolts which fix the first member to the third member, each of the second bolts passing through one of the second attachment holes, wherein the first member is fixed to the second member using a smaller number of the first bolts than a number of the first attachment holes, and is fixed to the third member using a smaller number of the second bolts than a number of the second attachment holes, the base further comprising:

a support member for supporting a deflector sheave on which the main rope is wound, wherein the support member is not fixed to the first member;

a fourth member in which third attachment holes are formed;

a third bolt which passes through one of the first attachment hole and fixes the fourth member to the second member;

a fourth bolt which passes through one of the second attachment hole and fixes the fourth member to the third member;

a fifth member in which fourth attachment holes are formed;

a fifth bolt which passes through one of the first attachment holes and fixes the fifth member to the second member;

a sixth bolt which passes through one of the second attachment holes and fixes the fifth member to the third member;

seventh bolts which fix the support member to the fourth member, each of the seventh bolts passing through one of the third attachment holes; and eighth bolts which fix the support member to the fifth member, each of the eighth bolts passing through one of the fourth attachment holes.

2. The traction machine base of an elevator according to claim 1, wherein the traction machine faces in a second direction at a prescribed height; and the first attachment holes and second attachment holes which are not used for fixing the first member are arranged in such a manner that in a case where the first member is fixed to the second member and the third member using these holes, the traction machine fixed to the first member faces in the second direction at the prescribed height.

3. The traction machine base of an elevator according to claim 1, wherein the plurality of first attachment holes are formed in a top surface of the second member along a longitudinal direction of the second member; and the plurality of second attachment holes are formed in a top surface of the third member along a longitudinal direction of the third member.

4. The traction machine base of an elevator according to claim 1, wherein the fifth member is fixed to one end of the second member and to one end of the third member and a notched portion for permitting the main rope to pass through is formed in a portion of the fifth member just above the deflector sheave.

5. The traction machine base of an elevator according to claim 1, wherein the fourth member is arranged between the first member and the fifth member.

6. An elevator device, comprising:

the traction machine base according to claim 1;

a traction machine supported on the traction machine base;

a main rope wound on a driving sheave of the traction machine;

a deflector sheave on which the main rope is wound; and a car and a counterweight which are suspended by the main rope in a shaft.

7. The elevator device according to claim 6, wherein the first member is fixed to the second member and the third member using the first attachment holes and second attachment holes in dependence on of a horizontal distance between a position where the main rope departs from the driving sheave toward the car and a position where the main rope departs from the deflector sheave toward the counterweight to a horizontal distance between a suspension position of the car and a suspension position of the counterweight.

* * * * *